US007571559B2

(12) United States Patent
Olsson

(10) Patent No.: US 7,571,559 B2
(45) Date of Patent: Aug. 11, 2009

(54) ARRANGEMENTS FOR FACILITATING ASSEMBLY, SERVICE AND MAINTENANCE OF IMAGE-CHANGING SIGNBOARDS

(75) Inventor: Lennart Olsson, Stockholm (SE); Hans-Lvar Olsson, legal representative, Saltsjo-Boo (SE)

(73) Assignee: Triple Sign System AB, Nacka (SE)

( * ) Notice: Subject to any disclaimer, the term of this patent is extended or adjusted under 35 U.S.C. 154(b) by 41 days.

(21) Appl. No.: 11/883,095

(22) PCT Filed: Jan. 18, 2006

(86) PCT No.: PCT/SE2006/000074

§ 371 (c)(1),
(2), (4) Date: Dec. 18, 2007

(87) PCT Pub. No.: WO2006/085807

PCT Pub. Date: Aug. 17, 2006

(65) Prior Publication Data

US 2008/0163525 A1 Jul. 10, 2008

Related U.S. Application Data

(60) Provisional application No. 60/593,782, filed on Feb. 14, 2005.

(51) Int. Cl.
*G09F 11/02* (2006.01)

(52) U.S. Cl. ..... 40/505; 74/84 R

(58) Field of Classification Search ..... 40/503–505; 74/84 R, 435

See application file for complete search history.

(56) References Cited

U.S. PATENT DOCUMENTS

| | | | | |
|---|---|---|---|---|
| 4,753,025 | A | 6/1988 | Wennström | |
| 5,233,772 | A * | 8/1993 | Bergeron et al. | 40/503 |
| 5,416,996 | A | 5/1995 | Clemens et al. | |
| 5,737,861 | A * | 4/1998 | Hansen | 40/505 |
| 6,128,841 | A | 10/2000 | Werner | |

OTHER PUBLICATIONS

International Search Report dated Apr. 10, 2006 in corresponding PCT Application No. 78658-82001 (Atty Ref 78658-82001), 4 pgs.
Written Opinion of the International Searching Authority dated Apr. 10, 2006 in corresponding PCT Application No. PCT/SE2006/000074 (Atty Ref 78658-82001), 4 pgs.3

* cited by examiner

*Primary Examiner*—Cassandra Davis
(74) *Attorney, Agent, or Firm*—Schwegman, Lundberg & Woessner, P.A.

(57) ABSTRACT

An image-changing signboard comprising an upper and a lower horizontal frame member (12, 14) having a substantially U-shaped cross-section. A plurality of vertical bar-shaped display elements having a triangular cross-section are rotatably mounted in the upper and lower frame members. Individual gear units (26, 32) are mounted in one (12) of the horizontal frame members for rotating a respective display element (18). A drive motor (20) is connected to a common drive shaft (24) for simultaneously rotating respective gear units (26, 32). A plurality of gear units (26, 32) are mounted on a common mounting plate (22) so as to form a drive module, which is slidably mounted on tracks (40) in one (12) of the U-shaped horizontal frame members and which form a bottom plate bridging the gap between the legs of the frame member (12) and facing the signboard display.

20 Claims, 3 Drawing Sheets

ARRANGEMENTS FOR FACILITATING ASSEMBLY, SERVICE AND MAINTENANCE OF IMAGE-CHANGING SIGNBOARDS

RELATED APPLICATIONS

This application is a nationalization under 35 U.S.C. 371 of PCT/SE2006/000074, filed Jan. 18, 2006 and published as WO 2006/085807 on Aug. 17, 2006, which claimed priority under 35 U.S.C. 119(e) to U.S. Provisional Patent Application Ser. No. 60/593,782, filed Feb. 14, 2005; which applications and publication are incorporated herein by reference and made a part hereof.

BACKGROUND OF THE INVENTION

1. Technical Field of the Invention

The invention generally relates to arrangements for facilitating assembly, service and maintenance of image-changing signboards. More particularly, the invention relates to an image-changing signboard of the kind comprising an upper and a lower horizontal frame member having a substantially U-shaped cross-section with two opposite legs and a web interconnecting the legs; two opposite, vertical side frame members connecting the horizontal frame members; a plurality of vertical bar-shaped display elements having a triangular cross-section and rotatably mounted in the upper and lower frame members; individual gear units mounted in one of the horizontal frame members for rotating a respective display element, each of said gear units comprising a drive wheel having at least one claw for intermittently engaging a driven, triangular gear wheel connected to a respective display element; and a drive motor connected to a common drive shaft for simultaneously rotating the respective drive wheels of the gear units.

2. Related Art

A previously known signboard of the kind mentioned above (EP 0 261 089 B1) comprises upper and lower horizontal frame members of aluminum, each of which having a U-shaped cross-section profile. The U-profile frame members are located such that one leg of the U is forming a bottom wall, whereas the opposite leg is forming a top wall of the frame member. The web portion connecting the legs of the U-profile is forming a rear wall of the frame member. Drive gear units of the rotatable display bars of the signboard are fixedly mounted in one of the horizontal frame members, usually the upper one. A cover plate is mounted on the front side of the U-shaped frame members. The gear units for the display members are individually mounted to fixed lower and rear walls of the U-profile which requires hole drilling operations in the profile and makes it difficult and cumbersome to carry out service and maintenance works on the signboard, such as demounting the drive gear units for replacement of components, as well as assembly of signboards of various dimensions.

SUMMARY OF THE INVENTION

According to one aspect of the invention, in order to achieve a quick and simplified assembly of the signboard of the kind mentioned by way of introduction the signboard of the present invention is characterized by the features set forth in the appended independent claim 1. This solution avoids expensive hole-drilling in the U-profile, and the gear units for the display elements may be preassembled into modules of a desired length and with a desired number of such units, e.g. 2, 3, 7 or 8 units, by mounting them in an individual mounting plate, which may be punched out from a flat, inexpensive plate blank and simultaneously punched with holes and bent to a configuration which is suitable for easy insertion thereof into an operative position in a respective frame member of a substantially U-shaped cross-section by sliding the mounting plate on tracks formed in the frame member, thereby closing the frame member by forming a "bottom" wall thereof facing the signboard display area. Thus, the frame member accommodating the drive mechanism consists of a two main components, i.e. an extruded, raw U-profile serving as an outer, decorative housing and carrier, and one or more mounting plates on which the drive mechanism is mounted. This allows for significantly reduced production costs for the signboard and simplified service and assembly efforts in-situ. Furthermore, owing to the possibility of forming modules of drive gear units attached to mounting plates of various lengths, signboards of various dimensions may easily be assembled in-situ.

The displaceable mounting plate (bottom wall) carrying a desired number of gear units is also easily removable from the fixed frame member for facilitating service and maintenance works such as replacement of separate drive components or complete modules of gear units on the signboard. This is accomplished by sliding the mounting plate (module) axially along the frame member to either remove the module completely for replacement, or to project sections thereof individually from the end of the frame member.

According to another aspect of the invention, to enable easy service and maintenance works in-situ on one or more gear modules or sections thereof in the frame member of the signboard, the mounting plate may be pulled out from the end of the frame member. For this purpose a separate supplemental U-shaped profile member forms a detachable end extension of the frame member and is provided with tracks corresponding to the tracks of the frame member in question. Thus, the supplemental profile member is a support member which is attachable to the end of the frame member so as to form a cantilevered longitudinal extension of at least the tracks of the frame member on which the mounting plate (modules) is slidably supported. The support member has at least one sufficiently large opening or "window" at the side thereof facing the viewer of the signboard so that a service person can gain easy access to the components of the drive gear units. The profile of e.g. an upper horizontal frame member accommodating one or more modules (mounting plates) of gear units for the display bars of the signboards is preferably that of an inverted U. Thus, the mounting plate, on which the gear units are attached, is forming a bottom wall that is slidable on tracks, such as inwardly projecting shoulders or flanges located near the free end of the two legs of the U-profile. Preferably, in order to easily join the support member to the frame member, the support member may be formed from a U-profile similar to that of the frame member or from a plate having been bent to such a U-shape and provided with said side window(s) for exposing the components of the retracted modules for maintenance and service. This structure of insertable and retractable mounting plates also allows for a flexible system of building up a signboard of arbitrary dimensions. The U-profiles forming the upper and lower frame members may be formed into various predetermined lengths to create a suitable modular system when building signboards of various dimensions. The frame member located opposite to the one accommodating the gear units may also be formed of a U-profile in which a mounting plate rotatably retaining the lower end of the display bars is insertable and retractable by sliding it axially along tracks, such as shoulders or flanges on the frame member. In this instance the mounting plate forms an upper cover of the U-shaped frame member.

Further features of the invention will be disclosed below and in the appended dependent claims with reference to the accompanying drawings.

DETAILED DESCRIPTION OF A PREFERRED EMBODIMENT

Figure 1:
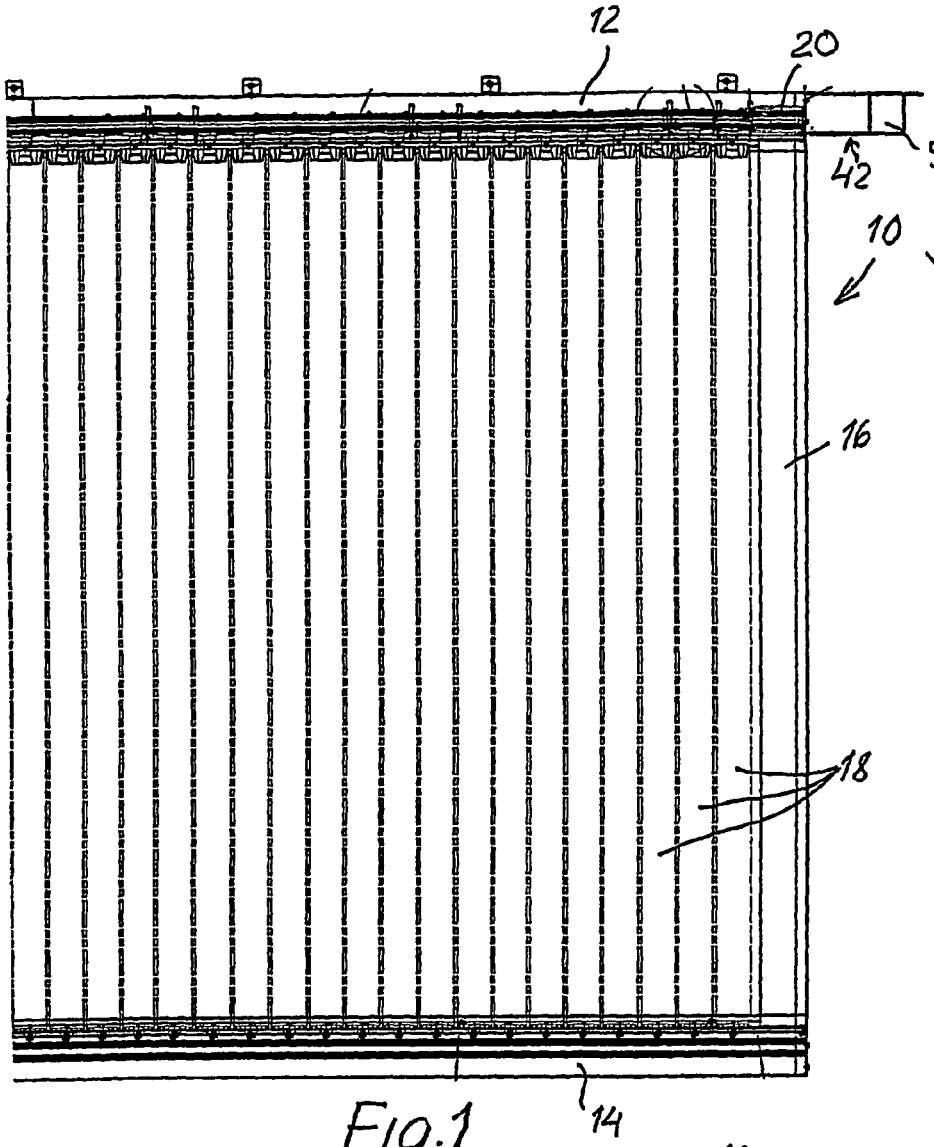
FIG. 1 is a side elevational view of a right half section of an image-changing signboard.
Figure 3:
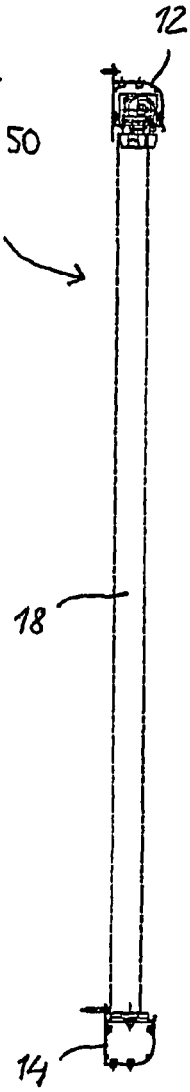
FIG. 3 is an end view of the signboard in FIG. 1.
Figure 2:
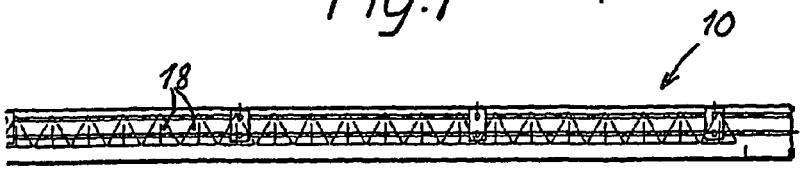
FIG. 2 is a plan view of the signboard in FIG. 1.
Figure 7:
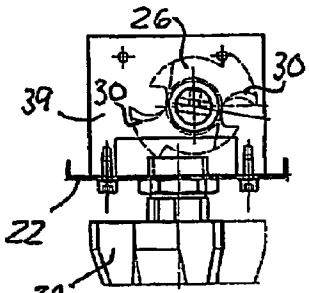
FIG. 7 is an end view of the module in FIG. 6.
Figure 4:
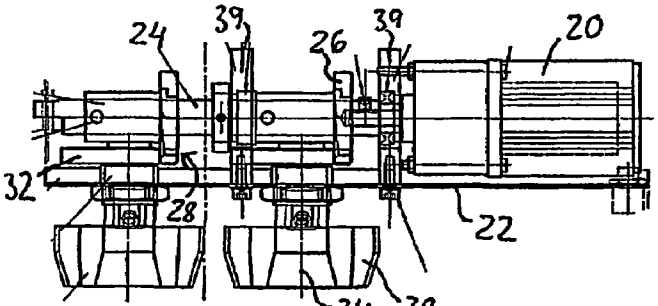
FIG. 4 is a side elevational view of a short module comprising a mounting plate with two gear units coupled to a drive motor at the upper right corner of the signboard in FIG. 1.

A right half of an image-changing signboard is generally denoted 10 in FIGS. 1-3. The signboard 10 comprises upper and lower horizontal frame members 12 and 14 and end or side frames 16 (only one shown in FIG. 1). A plurality of vertical bar-shaped display elements 18 having a triangular cross-section are rotatably mounted in the upper and lower frame members 12, 14. The frame members 12, 14 have a substantially U-shaped cross-section with two opposite legs 13 and a web 15 interconnecting the legs (see FIGS. 8 and 9). The upper frame member 12 accommodates a drive assembly for rotating the display elements 18. This drive assembly comprises an electric motor 20 (FIG. 4) mounted to a mounting plate 22 (FIGS. 4-7), a drive shaft 24 driven by the motor 20 for rotating a drive wheel 26 of a respective drive gear unit 28 for each display element 18. Each drive wheel 26 has at least one, but preferably two claws 30 for intermittently engaging a lug (not shown) at each apex of a driven, triangular gear wheel 32, the axis 34 of which is oriented at an angle of 90° to the axis of the drive shaft 24. Each gear wheel 32 is attached to a pin 36 rotatably supported in the mounting plate 22 about its respective axis 34 so as to, when the drive shaft 24 is continuously rotating, intermittently rotate a respective display element holder 38 120° and thereby a display element 18 attached thereto. Thus, each drive wheel 26 and each driven gear wheel 32 form the so called gear unit 28.

The drive assembly, i.e. the motor 20, the shaft 24 and the gear units 28 are all mounted to the mounting plate 22. Depending on the size (the width) of the signboard 10 the drive assembly may comprise various numbers of gear units 28, e.g. 2 (FIG. 4), 3, 7 (FIG. 6) or 8 units, with or without an own electric motor 20, to form various modules which could be easily assembled to form a complete upper frame of the signboard or a right (FIG. 1), or a left half thereof. The drive shaft 24 of one module may be detachably connected to the shaft of an adjacent module. Support brackets 39 (FIGS. 4-7 and 9) may support the shaft 24 at intervals along in the longitudinal extension thereof. As known, the claws 30 of the adjacent drive wheels 26 along the shaft 24 are preferably mutually displaced circumferentially (not shown) to create a wave-like motion of the image being displayed while rotating the display elements 18.

Figure 8:
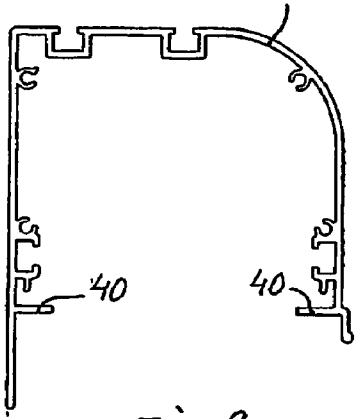
FIG. 8 is a cross-sectional view of a U-shaped upper horizontal frame member of the signboard.
Figure 6:
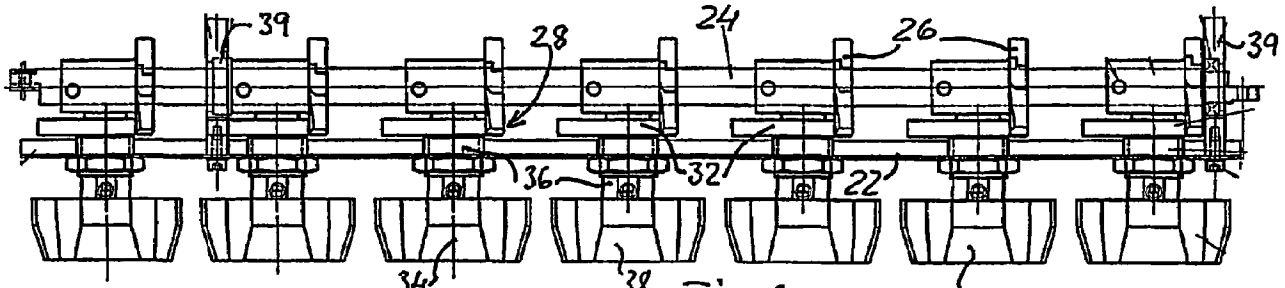
FIG. 6 is a side elevational view of a long module having seven gear units mounted to a mounting plate and coupled to a common drive shaft section.
Figure 5:
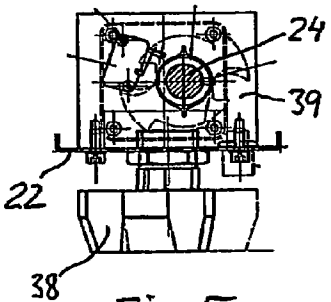
FIG. 5 is an end view of the module in FIG. 4.
Figure 9:
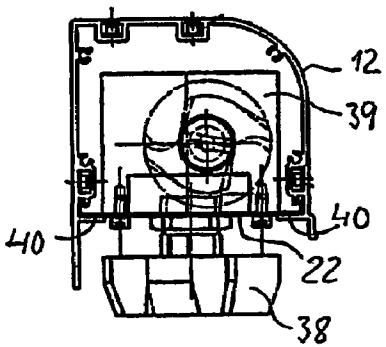
FIG. 9 is an end view of a drive gear unit mounted in a U-shaped frame member.
Figure 11:
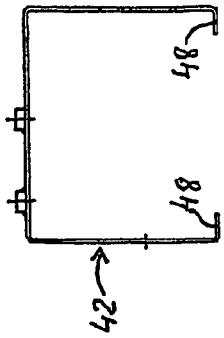
FIG. 11 is an end view of the support member in FIG. 9.
Figure 10:
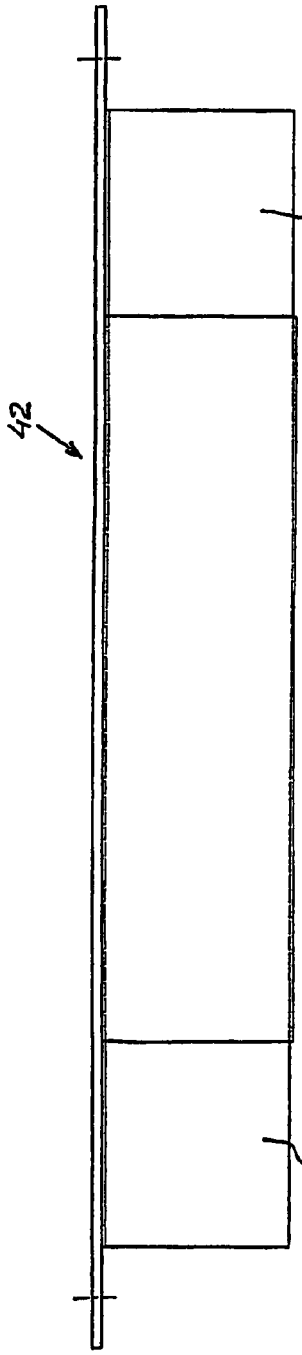
FIG. 10 is a side elevational view of a separate support member to be attached as an end extension to the upper frame member of the signboard shown in FIG. 1.
Figure 12:
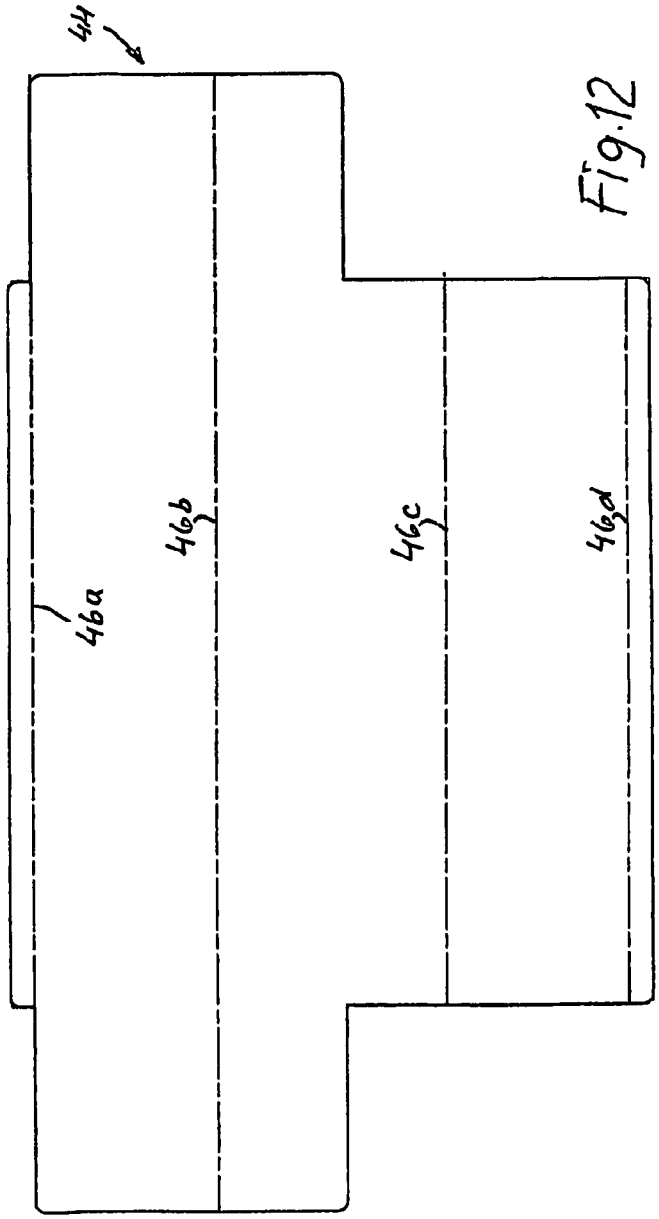
FIG. 12 is a plan view of a plate blank from which the support member is to be bent to its finished shape in FIG. 11.

According to the invention, as shown in FIGS. 8 and 9, a module comprising the mounting plate 22 together with the gear units 28, the drive shaft 24 and possibly the drive motor 20 is insertable into and retractable from the U-shaped frame member 12 by displacing it on inwardly directed, opposite tracks 40 (supporting flanges). This greatly facilitates the work of building-up or assembling the signboard as well as any necessary service and maintenance operations in-situ. For the latter purpose, a supplemental U-shaped profile 42 forming a detachable end extension of the frame member 12 is provided with tracks 48 corresponding to the tracks 40 of the frame member 12 (see FIGS. 1, 10 and 11). The supplemental U-shaped profile 42 constitutes a separate support member which may be temporarily attached to the end of the frame member 12 so as to form a cantilevered longitudinal extension of at least the tracks 40 of the frame member 12 on which the mounting plate 22 and the modules are slidably supported. This will facilitate service and replacement works. As seen in FIG. 12, the support member 42 may be formed from a flat blank 44 by bending it along the chain-dotted lines 46*a-d* into the profile shown in FIG. 11. Flanges or tracks 48 of the support member 42 thereby form extensions of the tracks 40 of the frame member 12. The support member 42 has at least one sufficiently large opening 50 or "window" at the side thereof facing the viewer of the signboard so that a service person can gain easy access to the components of the drive gear units 28. Alternately, the same U-profile as that of the upper frame member 12 may be used for the support member 42.

Although in the described preferred embodiment the drive modules are mounted in the upper horizontal frame member, it is possible within the scope of the present invention to arrange them in the lower horizontal frame member. Without leaving the concept of the invention it would also be conceivable to arrange the drive modules in vertically arranged frame members so as to rotate horizontally oriented display elements.

The invention claimed is:

1. An image-changing signboard, comprising:

an upper and a lower horizontal frame member having a substantially U-shaped cross-section with two opposite legs and a web interconnecting the legs;

two opposite, vertical side frame members connecting the horizontal frame members;

a plurality of vertical bar-shaped display elements having a triangular cross-section and rotatably mounted in the upper and lower frame members;

individual gear units mounted in one of the horizontal frame members for rotating a respective display element, each of said gear units comprising a drive wheel having at least one claw for intermittently engaging a driven, triangular gear wheel connected to a respective display element;

a drive motor connected to a common drive shaft for simultaneously rotating the respective drive wheels of the gear units, and a plurality of the gear units are mounted on a common mounting plate so as to form a drive module, which is slidably mounted on tracks on the legs of said one of the U-shaped horizontal frame members and which form a bottom plate bridging the gap between the legs of said one frame member.

2. The image-changing signboard of claim 1, wherein the drive motor is mounted on the mounting plate forming an end drive module in said one frame member.

3. The image-changing signboard of claim 2, wherein the drive shaft is supported by at least two brackets attached to each mounting plate.

4. The image-changing signboard of claim 3, wherein the drive shaft is divided into interconnectable sections of a length corresponding to the length of the respective drive module.

5. The image-changing signboard of claim 4, wherein a supplemental U-shaped profile member forming a detachable end extension of said one frame member and provided with tracks corresponding to the tracks of said one frame member.

6. The image-changing signboard of claim 5, wherein the end extension is provided with at least one service access opening in the leg of the U-shaped profile member facing the viewer of the signboard.

7. The image-changing signboard of claim 1, wherein the drive shaft is supported by at least two brackets attached to each mounting plate.

8. The image-changing signboard of claim 7, wherein the drive shaft is divided into interconnectable sections of a length corresponding to the length of the respective drive module.

9. The image-changing signboard of claim 8, wherein a supplemental U-shaped profile member forming a detachable end extension of said one frame member and provided with tracks corresponding to the tracks of said one frame member.

10. The image-changing signboard of claim 9, wherein the end extension is provided with at least one service access opening in the leg of the U-shaped profile member facing the viewer of the signboard.

11. The image-changing signboard of claim 1, wherein the drive shaft is divided into interconnectable sections of a length corresponding to the length of the respective drive module.

12. The image-changing signboard of claim 1, wherein a supplemental U-shaped profile member forming a detachable end extension of said one frame member and provided with tracks corresponding to the tracks of said one frame member.

13. The image-changing signboard of claim 12, wherein the end extension is provided with at least one service access opening in the leg of the U-shaped profile member facing the viewer of the signboard.

14. An image-changing signboard, comprising:

an upper frame, a lower frame, a side frame member connecting the upper frame to the lower frame, a plurality of vertical display elements comprising a plurality of sides and rotatably mounted in to upper and lower frame members, and a drive module slidably mounted to legs of one of the upper frame and the lower frame, wherein the drive module comprises:

a drive motor, a mounting plate, a plurality of gear units connected to the vertical display elements respectively and to rotate a respective display element, wherein the plurality of gear units are supported by the mounting plate such that the gear units are mounted in the one of the upper frame and the lower frame, each of the gear units comprising a drive wheel including at least one claw to intermittently engaging a driven gear wheel connected to a respective display element, and a common drive shaft for simultaneously rotating the respective drive wheels of the gear units.

15. The image-changing signboard of claim 14, wherein the drive module bridge a gap between the legs of the one frame.

16. The image-changing signboard of claim 14, wherein the lower frame comprises a substantially U-shaped cross-section with two opposite legs and a web interconnecting the legs.

17. The image-changing signboard of claim 14, wherein the upper frame comprises a substantially U-shaped cross-section with two opposite legs and a web interconnecting the legs.

18. The image-changing signboard of claim 14, wherein the display elements include three sides, and wherein the drive wheel is triangular.

19. The image-changing signboard of claim 14, wherein the drive motor is mounted on an end of the mounting plate in the one frame member.

20. The image-changing signboard of claim 14, wherein the drive shaft is supported by at least two brackets attached to each mounting plate, and wherein the drive shaft is divided into interconnectable sections of a length corresponding to the length of the respective drive module.

* * * * *